US009095481B2

(12) United States Patent
Essers

(10) Patent No.: US 9,095,481 B2
(45) Date of Patent: Aug. 4, 2015

(54) PAD, IN PARTICULAR FOR USE IN THE NURSING CARE AND HOSPITAL SECTOR

(75) Inventor: Heinz-Willy Essers, Wassenberg (DE)

(73) Assignee: Heinrich Essers GmbH & Co. KG, Wassenberg (DE)

( * ) Notice: Subject to any disclaimer, the term of this patent is extended or adjusted under 35 U.S.C. 154(b) by 84 days.

(21) Appl. No.: 13/581,679

(22) PCT Filed: Mar. 4, 2011

(86) PCT No.: PCT/EP2011/053269

§ 371 (c)(1),
(2), (4) Date: Aug. 29, 2012

(87) PCT Pub. No.: WO2011/107580

PCT Pub. Date: Sep. 9, 2011

(65) Prior Publication Data

US 2012/0324651 A1 Dec. 27, 2012

(30) Foreign Application Priority Data

Mar. 4, 2010 (DE) ..... 10 2010 002 572
Apr. 28, 2010 (DE) ..... 10 2010 028 316

(51) Int. Cl.
*A61G 7/057* (2006.01)
*A47C 7/02* (2006.01)
*A47C 27/00* (2006.01)
(Continued)

(52) U.S. Cl.
CPC ..... *A61G 7/05715* (2013.01); *A47C 7/021* (2013.01); *A47C 27/005* (2013.01); *A47C 27/007* (2013.01); *A47C 27/22* (2013.01); *A47C 31/006* (2013.01); *A47C 31/105* (2013.01)

(58) Field of Classification Search
CPC .... A47C 21/04; A47C 21/042; A47C 21/046; A47C 27/001; A47C 27/12; A47C 27/121; A47C 27/122; A47C 27/14; A47C 27/142; A47C 27/144; A47C 27/15; A47C 27/22; A47C 31/006; A47C 27/005; A47C 27/007; A47C 27/021; A47C 31/105; A47G 9/10; A47G 9/1036; A47G 2009/10; A47G 2009/1018; A61G 7/05715
USPC ..... 5/630, 632, 638, 645, 724, 652, 652.1, 5/653, 655.9, 902, 948, 952, 953
See application file for complete search history.

(56) References Cited

U.S. PATENT DOCUMENTS 4,865,379 A * 9/1989 Aoki et al. ..... 297/180.12
6,085,369 A * 7/2000 Feher ..... 5/423
(Continued)

FOREIGN PATENT DOCUMENTS

DE 203 06 348 U1 9/2003
DE 20 2005 005 028 U1 8/2006
(Continued)

*Primary Examiner* — Nicholas Polito
(74) *Attorney, Agent, or Firm* — McGlew and Tuttle, P.C.

(57) ABSTRACT

A pad, in particular for use in the nursing care and hospital sector, has an elastic spacer textile, which is surrounded by an elastic foam body, a separating layer being arranged between the foam body and the spacer textile. The pad can be produced with any desired outer contour by foaming the foam body onto the spacer textile, an uncontrolled penetration of the foam body into the spacer textile and an undesired increase in the compression hardness connected therewith being avoided by the separating layer. The pad is accordingly very comfortable to sit and/or lie on.

18 Claims, 3 Drawing Sheets

(51) Int. Cl.

| | |
|---|---|
| ***A47C 27/22*** | (2006.01) |
| ***A47C 31/00*** | (2006.01) |
| ***A47C 31/10*** | (2006.01) |

(56) References Cited

U.S. PATENT DOCUMENTS

| | | | | |
|---|---|---|---|---|
| 2007/0232172 | A1 | 10/2007 | Biermann | |
| 2009/0033130 | A1 * | 2/2009 | Marquette et al. | 297/180.15 |
| 2010/0045079 | A1 * | 2/2010 | Andersson et al. | 297/180.14 |

FOREIGN PATENT DOCUMENTS

| | | | |
|---|---|---|---|
| DE | 20 2006 007468 | U1 | 8/2006 |
| DE | 10 2005 043 864 | A1 | 3/2007 |
| DE | 10 2005 060 931 | A1 | 6/2007 |
| DE | 10 2006 016 107 | A1 | 10/2007 |
| DE | 100 26 405 | B4 | 2/2008 |
| DE | 10 2007 059 274 | A1 | 6/2009 |
| EP | 1 762 211 | A1 | 3/2007 |
| EP | 1 842 458 | A2 | 10/2007 |
| WO | 96/32526 | A1 | 10/1996 |

* cited by examiner

PAD, IN PARTICULAR FOR USE IN THE NURSING CARE AND HOSPITAL SECTOR

CROSS REFERENCE TO RELATED APPLICATIONS

This application is a United States National Phase application of International Application PCT/EP2011/053269 and claims the benefit of priority under 35 U.S.C. §119 of German Patent Application Serial No. 10 2010 002 572.0 filed Mar. 4, 2010 and German Patent Application Serial No. 10 2010 028 316.9 filed Apr. 28, 2010, the entire contents of which are incorporated herein by reference.

FIELD OF THE INVENTION

The invention relates to a pad, in particular for use in the nursing care and hospital sector.

BACKGROUND OF THE INVENTION

Pads are used for people to sit and/or lie on comfortably and may, for example, be placed on conventional chairs or mattresses in order to improve their sitting and/or lying properties. Pads of this type have to satisfy further requirements in the nursing care and hospital sector. Apart from comfortable sitting and/or lying properties, pads of this type have to be robust and easy to clean. Pads generally have a substantially rectangular outer contour. However, there is increasingly a need for pads having an outer contour which differs from this.

SUMMARY OF THE INVENTION

The invention is based on an object of providing a simple and comfortable pad having a non-rectangular outer contour.

This object is achieved by a pad comprising an elastic spacer textile and an elastic foam body, wherein the foam body surrounds the spacer textile and a separating layer is arranged between the foam body and the spacer textile. It was recognized according to the invention that a pad with any desired, non-rectangular outer contour can easily be produced in that a foam body is foamed onto an elastic spacer textile. The spacer textile is, for example, configured as a warp-knitted spacer fabric or a weft-knitted spacer fabric and, because of its production method, can be produced particularly easily with a rectangular outer contour. In contrast, the foam body can easily be produced in any shape or with any desired outer contour. The spacer textile, because of its construction, provides a high degree of sitting and/or lying comfort, whereas the desired outer contour is achieved with the foam body. For this purpose, the foam body completely surrounds the spacer textile in the regions to be formed. In order to prevent an undesired increase in the compression hardness by foam entering the spacer textile, the spacer textile is completely surrounded by a separating layer. The separating layer preferably comprises a film and/or a membrane. The cushioning and damping properties of the spacer textile are not impaired by the separating layer, so a pad contoured in any desired manner with a high degree of sitting and/or lying comfort is easily achieved.

By foaming on the foam body, a high degree of flexibility is achieved in the contouring of the pad. The production of pads made from rectangular warp-knitted spacer fabrics or weft-knitted spacer fabrics in combination with a foam body is economically all the more advantageous, the more complex is the contouring, as regardless of the contouring, easily producible, plate-shaped warp-knitted spacer fabrics or weft-knitted spacer fabrics can be used. As a result, a high degree of contouring freedom is achieved with low production costs.

The foam body and the spacer textile are preferably air-permeable and liquid-permeable, so the pad has a high degree of breathability and at the same time guides liquids, such as, for example, sweat, blood and/or urine from a surface facing the user into the interior of the pad. In order to protect the foam body and the spacer textile from soiling, the latter are preferably completely surrounded by an outer casing. The outer casing is removable from the foam body, in particular for cleaning purposes and, for this purpose, for example has a zip fastener, which is arranged between an outer casing lower part and an outer casing upper part.

In particular, the pad according to the invention can be used to improve the sitting and/or lying properties of existing seat cushions and/or mattresses by additionally arranging the pad thereon. A retrofitting of this type of existing seat cushions and/or mattresses is comparatively economical in comparison to a completely new seat cushion or a completely new mattress, which is very important, in particular in the nursing care and hospital sector. The pad preferably has a pad height of 10 mm to 200 mm, in particular for 20 mm to 150 mm. The sitting and/or lying comfort of the pad increases with an increasing pad height as a better pressure distribution and better spring deflections are achieved thereby, in particular in the case of a concentrated load.

A pad, in which the separating layer has a plurality of through-openings and the foam body extends through the through-openings into the spacer textile, improves the sitting and/or lying comfort. A defined quantity of foam can enter the spacer textile through the through-openings when the foam body is foamed on, so a connection is achieved between the foam body and the spacer textile without the compression hardness of the spacer textile undesirably increasing. Owing to the connection, loads on the pad are better distributed therein, leading to a greater degree of sitting and/or lying comfort. The through-openings are preferably arranged on a plurality of sides of the rectangular spacer textile, in particular on all sides. The separating layer may, for example, comprise a film or a membrane, which has any desired, in particular a strip-like or point-like, perforation.

A pad, in which the separating layer has an adhesion promoter on at least one side, improves the sitting and/or lying comfort as the connection between the foam body and the spacer textile and the separating layer is improved. Movements between the foam body and the spacer textile are therefore transmitted better and loads are better distributed.

A pad, in which the separating layer has an adhesion promoter, in each case, on a spacer textile side and on a foam body side, has improved sitting and/or lying comfort as movements between the foam body and the spacer textile are directly transmitted via the separating layer and loads are better distributed. A high degree of sitting and/or lying comfort is achieved, in particular in conjunction with the through-openings.

A pad, in which the foam body extending into the spacer textile forms a plurality of connecting elements, which in each case surround a part of the spacer textile, has an optimal connection between the foam body and the spacer textile, without a significant increase in compression hardness being produced.

A pad, in which the separating layer comprises an air-permeable membrane, which, in particular, is also liquid-permeable, has a high degree of breathability. If the membrane is additionally liquid-permeable, liquids are effectively guided away from a surface facing a user into the interior of the spacer textile.

A pad, in which the spacer textile has a rectangular spacer textile outer contour and the foam body has a non-rectangular foam body outer contour, can be easily and economically produced. Rectangular spacer textiles, in comparison to non-rectangular spacer textiles, are simple and economical, so these are particularly suitable for producing pads contoured in any desired manner.

A pad, in which the spacer textile is configured as a knitted spacer fabric and has two covering layers connected to one another by spacer threads, is robust and comfortable.

A pad, in which the spacer threads form thread groups running in a plane, with an IXI shape, because of the IXI shape of the large number of spacer thread groups, has a high degree of elasticity and dimensional stability. Pressure loads can be resiliently absorbed by the spacer threads, whereupon they return to the original shape once the pressure loading ceases. Because of the high degree of dimensional stability, the knitted spacer fabric can be formed with a height of 2 to 100 mm, in particular form 5 to 80 mm, in particular from 15 to 60 mm and, in particular, from 20 to 50 mm without the latter permanently deforming because of the pressure loads.

A pad, in which the foam body and the spacer textile are air-permeable and liquid-permeable, has a high degree of breathability and guides liquids from a surface facing a user into the interior of the pad.

A pad, in which the foam body is surrounded by an outer casing, which is liquid-impermeable on a lower side remote from a user, prevents liquid being able to escape from the outer casing so that items arranged under the pad, such as, for example, a chair or a mattress, are not soiled.

A pad, in which the outer casing has a liquid-impermeable outer casing lower part on the lower side and a liquid-permeable outer casing upper part on an upper side facing the user, has a high degree of comfort, as, on the one hand, air can circulate through the outer casing upper part and, on the other hand, liquid can be guided away from the surface facing the user into the interior of the pad. Moreover, this liquid cannot escape through the outer casing lower part, so soiling of items arranged therebelow is avoided.

A pad, in which the outer casing lower part is in the form of a trough, allows a large quantity of liquid to be absorbed without it escaping laterally. The outer casing lower part preferably has liquid-impermeable side cheeks extending to the outer casing upper part.

A pad, in which the foam body and the spacer textile form an upper layer, which is arranged on an elastic lower layer, the upper layer and the lower layer being surrounded by an outer casing, improves the sitting and/or lying comfort. The additional elasticity of the lower layer is, in particular, advantageous for a pressure-relieving soft support in conjunction with a decubitus-prophylaxis and/or therapy. The lower layer is, for example, configured as a shaped body made of foam. The lower layer and the upper layer are, in particular, arranged in a shear-resistant manner above one another, which is achieved, for example, by an anti-slip coating and/or partial provision of the side of the lower layer facing the upper layer with knobs.

A pad, in which the lower layer is liquid-impermeable and, in particular, has a shaped body made of foam, which is surrounded by a liquid-impermeable shaped body casing, is robust and can be reprocessed frequently. To reprocess the pad, the outer casing can be removed from the lower layer and the upper layer. For this purpose, the outer casing, for example, has a zip fastener, which is arranged between the outer casing lower part and the outer casing upper part. During the reprocessing, only the outer casing and the upper layer have to be completely cleaned. The liquid-impermeable lower layer which, because of the liquid collecting in the region of the outer casing lower part is subject to more difficult soiling conditions, only has to be cleaned on the outside, so a simple reprocessing is possible. The liquid impermeability is preferably achieved by a liquid-impermeable shaped body casing, such as, for example, by a polyurethane coating.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
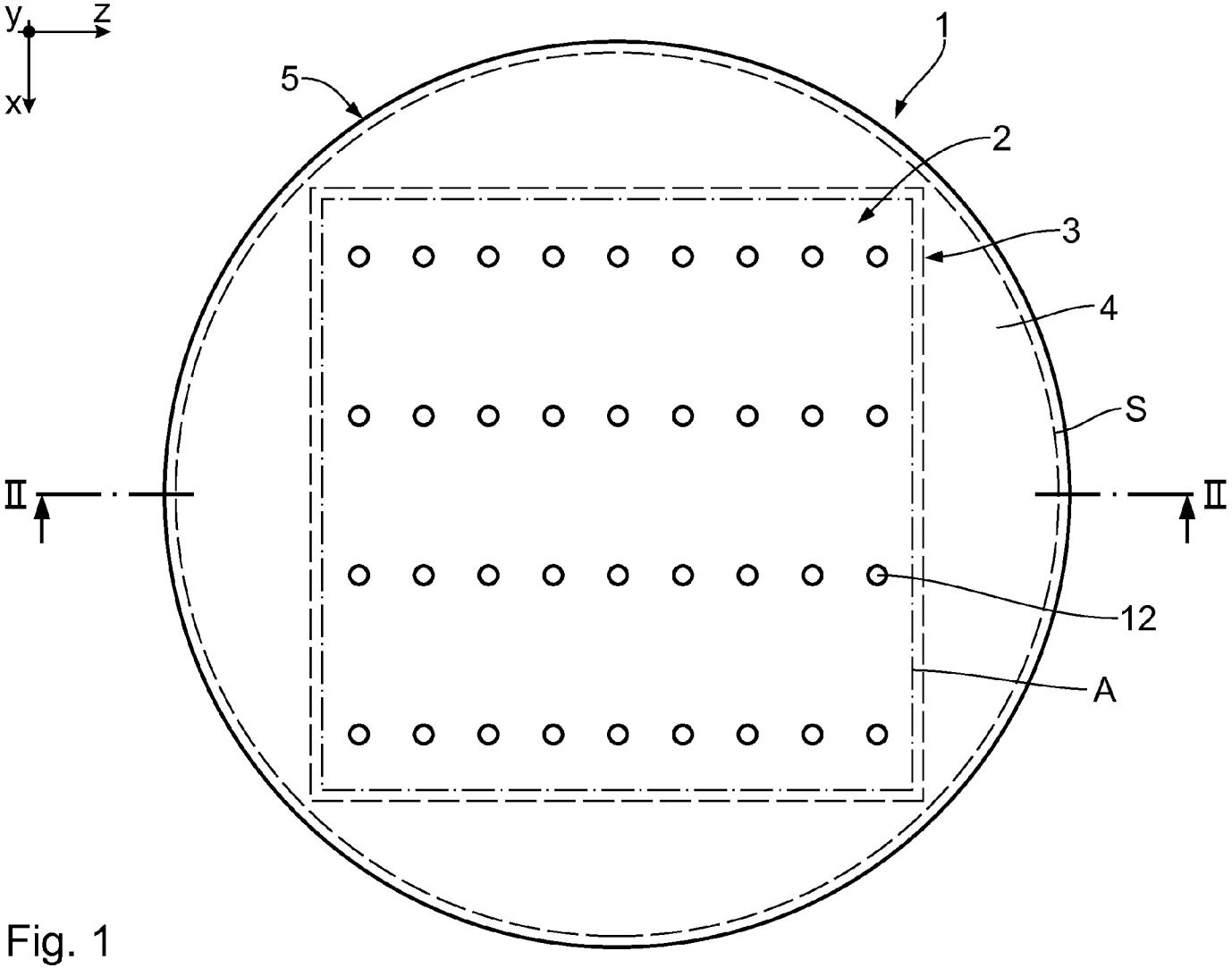
FIG. 1 is a plan view of a pad according to a first embodiment.
Figure 2:
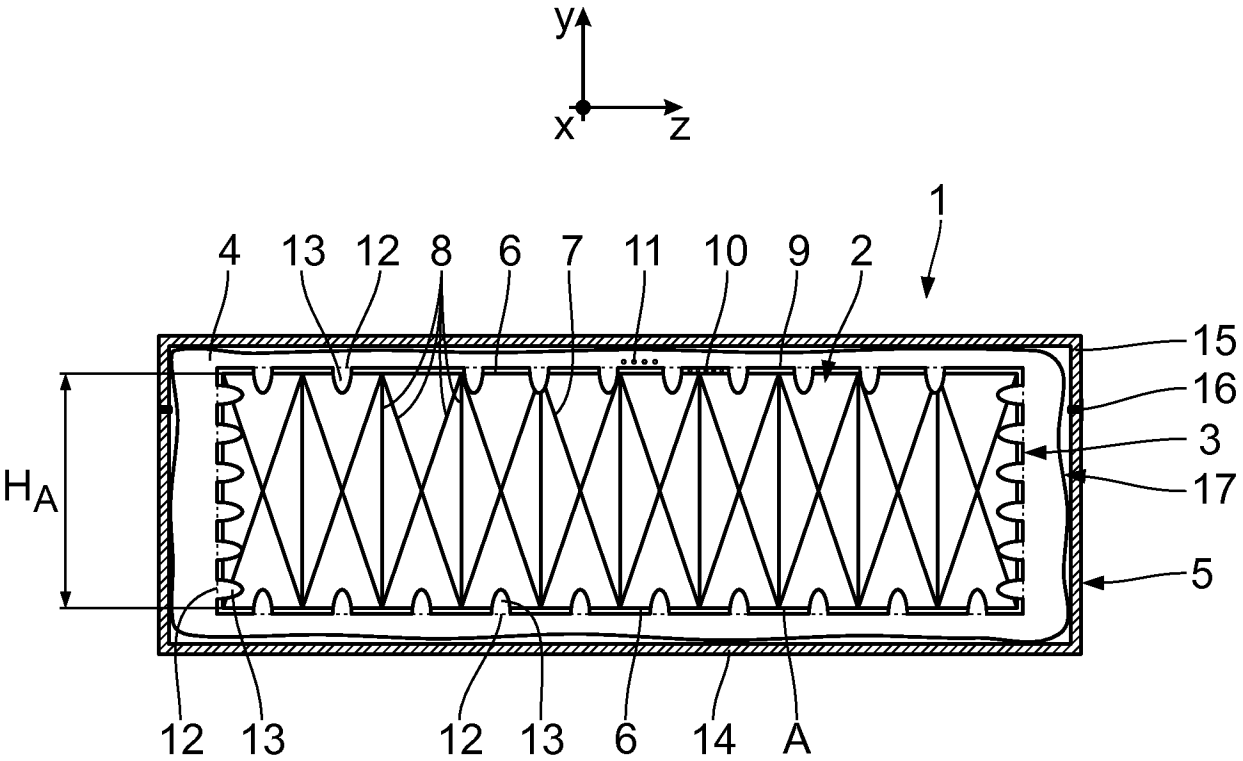
FIG. 2 is a sectional view through the pad in FIG. 1 along the section line II-II.

A first embodiment of the invention will be described below with the aid of FIGS. 1 and 2. The pad 1 shown in FIG. 1 is used as a seat cushion, for example in use in the nursing care and hospital sector. The pad 1 has a spacer textile 2 in the form of a knitted spacer fabric, which extends substantially in an x- and a z-direction and is rectangular in an x-z-plane defined by these directions, in other words has a rectangular spacer textile outer contour A. The spacer textile 2 is designated a knitted spacer fabric below.

The knitted spacer fabric 2 is completely surrounded by a separating layer 3. The separating layer 3 substantially separates the knitted spacer fabric 2 from a foam body 4, which completely surrounds the knitted spacer fabric 2 and is substantially circular in the x-z-plane, in other words has a non-rectangular foam body outer contour S. The foam body 4 is completely surrounded by an outer casing 5.

The knitted spacer fabric 2 has two covering layers 6 which extend substantially parallel to one another and are connected to one another by spacer threads 7. The spacer threads 7 form spacer thread groups 8, which extend in a y-z-plane and have an IXI shape. This is shown in FIG. 2. The IXI shape is formed by two spacer threads 7 extending perpendicular to the covering layers 6 and two spacer threads 7, which intersect and extend, for example, at an angle of 45°. The knitted spacer fabric 2 has a height HA in the range from 2 to 100 mm, in particular from 5 to 80 mm, in particular from 15 to 60 mm and in particular from 20 to 50 mm. The threads of the covering layers 6 and/or the spacer threads 7 may be configured as monofilaments and/or multifilaments and consist, for example, of polyester. The knitted spacer fabric 2 is air-permeable and liquid-permeable. Reference is made to DE 100 26 405 B4 with regard to the construction and the material of the knitted spacer fabric 2.

The separating layer 3 has a membrane 9, which is air-permeable and liquid-permeable, but is impermeable to the foam of the foam body 4 and accordingly separates the foam body 4 from the knitted spacer fabric 2. The separating layer 3, on a spacer textile side facing the knitted spacer fabric 2, has a first adhesion promoter 10 and, on a foam body side facing the foam body 4, has a second adhesion promoter 11. The affine adhesion promoters 10, 11 are only indicated in FIG. 2.

For the targeted connection of the foam body 4 to the knitted spacer fabric 2, the separating layer 3 on all sides has a plurality of through-openings 12, through which the foam body 4 extends into the knitted spacer fabric 2 in a desired manner. The foam body 4, through the through-openings 12, forms connecting elements 13, which are connected to a part of the knitted spacer fabric 2, in other words to the covering layers 6 and/or the spacer threads 7 and surround them. In this manner, a permanent connection is achieved between the foam body 4 and the knitted spacer fabric 2.

The foam body 4, the membrane 9 and the knitted spacer fabric 2 are air-permeable and liquid-permeable, so they have a high degree of breathability and liquids on the surface of the foam body 4 can be guided away into the interior.

The outer casing 5, on a lower side facing a user, has an outer casing lower part 14 and, on an upper side facing the user, an outer casing upper part 15, which are connected to one another by means of a zip fastener 16. The outer casing lower part 14 is formed as a liquid-impermeable trough to avoid liquid escaping laterally. The outer casing lower part 14 consists, for example, of polyurethane or of polyester with an outer polyurethane coating. The outer casing lower part 14 preferably has liquid-impermeable side troughs, which extend to the height of the zip fastener 16. The outer casing upper part 15 forming a seat surface is air-permeable and liquid-permeable. The outer casing upper part 15 is preferably an elastic warp-knitted and/or weft-knitted fabric, which, depending on the position of the zip fastener 16, is two-dimensional or three-dimensional.

The pad 1 is produced by foaming the foam body 4 onto the knitted spacer fabric 2. During the foaming, foam passes in a controlled manner through the through-openings 12 of the separating layer 3, the foam on hardening forming the connecting elements 13. Owing to the foaming, pads 1 contoured in any desired manner can be produced starting from a knitted spacer fabric 2 with a rectangular outer contour A. Since the foam only enters the knitted spacer fabric 2 in a targeted manner in the region of the through-openings 12, an undesired increase in the compression hardness of the knitted spacer fabric 2 is avoided.

The outer casing upper part 15 provides a seat surface, for example for a patient in a hospital. Liquids located on the outer casing upper part 15 pass through the latter into the interior of the outer casing 5 and from there through the foam body 4 into the interior of the knitted spacer fabric 2. The liquid escaping again from the knitted spacer fabric 2 collects in the outer casing lower part 14, the latter preventing an escape of the liquid owing to the trough-shaped and liquid-impermeable configuration. A high degree of breathability of the pad 1 is ensured by the air-permeability of the outer casing upper part 15, the foam body 4 and the knitted spacer fabric 2.

To reprocess or clean the pad 1, the zip fastener 16 is opened and the foam body 4 with the knitted spacer fabric 2 is removed. The foam body 4 and the knitted spacer fabric 2 can then be cleaned separately from the outer casing 5. If the soiling of the foam body 4 with the knitted spacer fabric 2 or the outer casing 5 is too heavy or wear that is too heavy has occurred because of frequent reprocessing, the foam body 4 with the knitted spacer fabric 2 or the outer casing 5 can be replaced.

Figure 3:
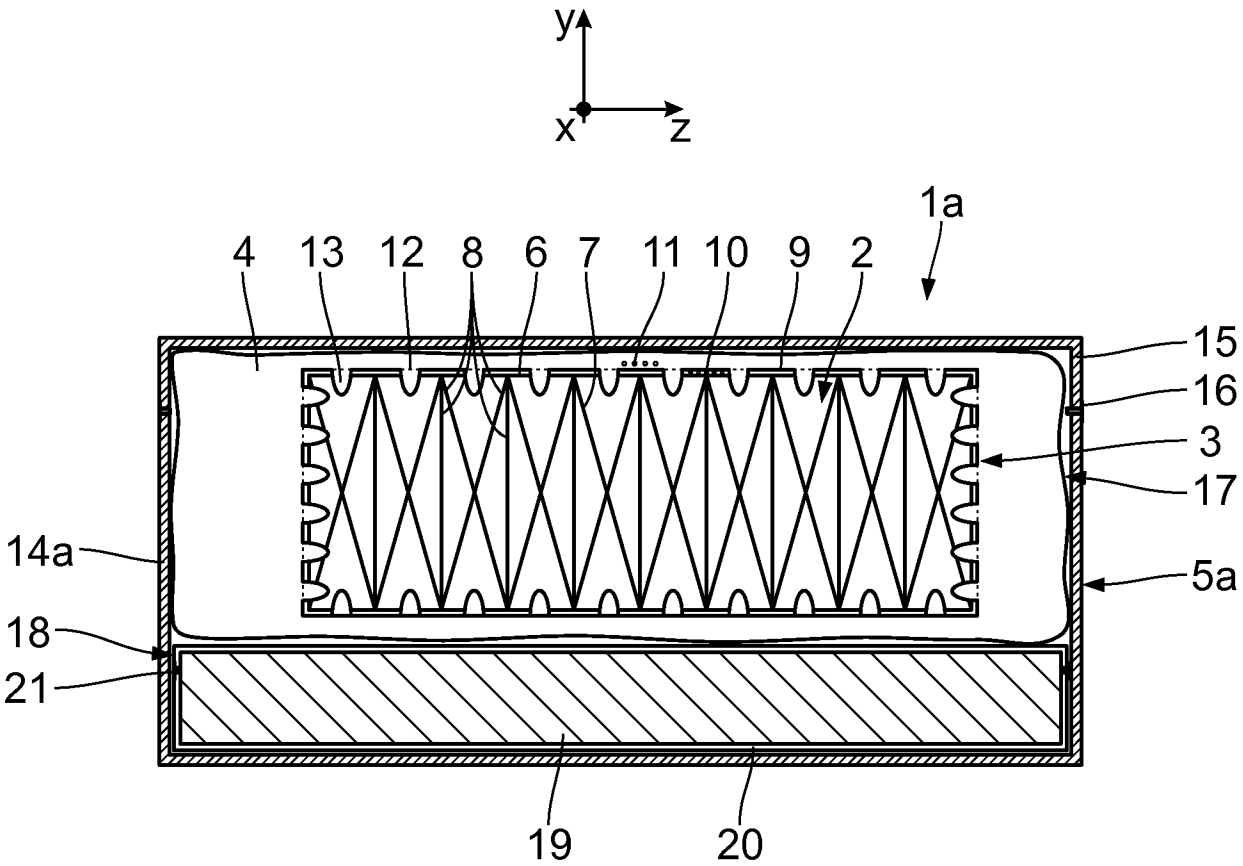
FIG. 3 is a sectional view through a pad according to a second embodiment in accordance with the section in FIG. 2.

A second embodiment of the invention will be described below with reference to FIG. 3. Structurally identical parts have the same reference numerals as in the first embodiment, to the description of which reference is hereby made. Structurally different, but functionally similar parts have the same reference numerals with an a thereafter. In contrast to the first embodiment, the pad 1*a* has a multi-layer construction. The foam body 4, together with the knitted spacer fabric 2, forms an upper layer 17, which is arranged in a y-direction on an elastic lower layer 18. The upper layer 17 and the lower layer 18 are arranged above one another in a shear-resistant manner in the x- and z-direction and completely surrounded together by the outer casing 5*a*.

The lower layer 18 is liquid-impermeable. For this purpose, the latter has a shaped body 19 made of foam, which is configured in accordance with the foam body outer contour S and is completely surrounded by a liquid-impermeable shaped body casing 20. The shaped body casing 20 can be removed from the shaped body 19. For this purpose, the shaped body casing 20 has a zip fastener 21. Alternatively, the shaped body casing 20 can also be permanently closed and, accordingly, not be removable from the shaped body 19. This takes place, for example, by welding the shaped body casing.

The shaped body 19 is, for example, made of reticulated foam and the associated shaped body casing 20 is made of polyurethane (PU) or of polyester with a PU coating.

The pad 1*a* has improved sitting comfort owing to the additional elasticity of the lower layer 18. Owing to the liquid-impermeable shaped body casing 20, liquid collecting in the outer casing lower part 14*a* cannot soil the shaped body 19. During a reprocessing of the pad 1*a*, the shaped body casing 20 merely has to be cleaned on the outside, so simple reprocessing is possible. To clean the shaped body casing 20, it can be disinfected by wiping, for example. With regard to the further construction and the further mode of functioning, reference is made to the first embodiment.

While specific embodiments of the invention have been shown and described in detail to illustrate the application of the principles of the invention, it will be understood that the invention may be embodied otherwise without departing from such principles.

The invention claimed is:

1. A pad, comprising:

an elastic spacer textile; and an elastic foam body, wherein the elastic foam body surrounds the elastic spacer textile and a separating layer is arranged on a plurality of sides between the elastic foam body and the elastic spacer textile, said separating layer having a plurality of through-openings and the elastic foam body extending through the through-openings into the elastic spacer textile, said elastic foam body forming a plurality of connecting elements, which in each case surround a part of said elastic spacer textile.

2. A pad according to claim 1, wherein the separating layer has an adhesion promoter on at least one side.

3. A pad according to claim 2, wherein the separating layer has an adhesion promoter, in each case, on a spacer textile side and on a foam body side.

4. A pad according to claim 1, wherein the separating layer comprises an air-permeable membrane.

5. A pad according to claim 4, wherein said air-permeable membrane is liquid-permeable.

6. A pad according to claim 1, wherein the elastic spacer textile has a rectangular spacer textile outer contour and the elastic foam body has a non-rectangular foam body outer contour.

7. A pad according to claim 1, wherein the elastic spacer textile is configured as a knitted spacer fabric and the elastic spacer textile has two covering layers connected to one another by spacer threads.

8. A pad according to claim 7, wherein the spacer threads form thread groups running in a plane, with an IXI shape.

9. A pad according to claim 1, wherein the elastic foam body and the elastic spacer textile are air-permeable and liquid-permeable.

10. A pad according to claim 1, wherein the elastic foam body is surrounded by an outer casing, which is liquid-impermeable on a lower side remote from a user.

11. A pad according to claim 10, wherein the outer casing has a liquid-impermeable outer casing lower part on the lower side and a liquid-permeable outer casing upper part on an upper side facing the user.

12. A pad according to claim 11, wherein the liquid-impermeable outer casing lower part is in a form of a trough.

13. A pad according to claim 1, wherein the elastic foam body and the elastic spacer textile form an upper layer, which is arranged on an elastic lower layer, the upper layer and the elastic lower layer being surrounded by an outer casing.

14. A pad according to claim 13, wherein the elastic lower layer is liquid-impermeable.

15. A pad according to claim 13, wherein the elastic lower layer is liquid-impermeable and said elastic lower layer has a shaped body made of foam, which is surrounded by a liquid-impermeable shaped body casing.

16. A pad according to claim 1, wherein the pad is used in a nursing care and hospital sector.

17. A pad according to claim 1, wherein said connecting elements are connected to a part of said elastic spacer textile such that a permanent connection is provided between said elastic foam body and said elastic spacer textile.

18. A pad, comprising:

an elastic spacer textile;

an elastic foam body, said elastic foam body surrounding said elastic spacer textile; and a separating layer arranged on a plurality of sides between the elastic foam body and the elastic spacer textile, each interior side of said elastic foam body being in direct contact with at least a portion of said separating layer, said separating layer having a plurality of through-openings, said elastic foam body comprising a plurality of elastic foam body projections, at least a portion of each of said elastic foam body projections being arranged in one of said through-openings to define a plurality of connecting elements, wherein said spacer textile is connected to said elastic foam body via said plurality of connecting elements.

* * * * *